US006493963B1

(12) United States Patent
England

(10) Patent No.: US 6,493,963 B1
(45) Date of Patent: Dec. 17, 2002

(54) METHOD AND APPARATUS FOR DRYNESS DETECTION IN A CLOTHES DRYER

(75) Inventor: Brent A. England, Newton, IA (US)

(73) Assignee: Maytag Corporation, Newton, IA (US)

( * ) Notice: Subject to any disclaimer, the term of this patent is extended or adjusted under 35 U.S.C. 154(b) by 76 days.

(21) Appl. No.: 09/864,450

(22) Filed: May 25, 2001

(51) Int. Cl.[7] ..... F26B 3/00; F26B 11/02

(52) U.S. Cl. ..... 34/491; 34/494; 34/528; 34/575; 34/606

(58) Field of Search ..... 34/423, 486, 491, 34/493, 494, 495, 527, 528, 543, 553, 572, 575, 606

(56) References Cited

U.S. PATENT DOCUMENTS

| | | | | |
|---|---|---|---|---|
| 3,088,221 | A | | 5/1963 | Pansing et al. |
| 3,271,877 | A | | 9/1966 | Guenther, Jr. et al. |
| 3,417,480 | A | | 12/1968 | Thunander |
| 3,571,945 | A | | 3/1971 | Elders |
| 3,733,712 | A | | 5/1973 | Smith |
| 3,762,064 | A | | 10/1973 | Offutt |
| 3,864,844 | A | | 2/1975 | Heidtmann |
| 4,397,101 | A | | 8/1983 | Rickard |
| 4,412,389 | A | | 11/1983 | Kruger |
| 4,477,982 | A | | 10/1984 | Cotton |
| 4,531,305 | A | | 7/1985 | Nagayasu et al. |
| 4,546,554 | A | | 10/1985 | Bullock et al. |
| 4,622,759 | A | | 11/1986 | Abe et al. |
| 4,640,022 | A | | 2/1987 | Suzuki et al. |
| 4,738,034 | A | | 4/1988 | Muramatsu et al. |
| 5,193,292 | A | | 3/1993 | Hart et al. |
| 5,245,764 | A | | 9/1993 | Sung |
| 5,291,667 | A | | 3/1994 | Joslin et al. |
| 5,345,694 | A | | 9/1994 | Hayashi |
| 5,367,265 | A | | 11/1994 | Gaudette |
| 5,444,924 | A | | 8/1995 | Joslin et al. |
| 5,467,077 | A | * | 11/1995 | Wunderlich et al. ..... 340/635 |
| 5,560,124 | A | | 10/1996 | Hart et al. |
| 5,682,684 | A | | 11/1997 | Wentzlaff et al. |
| 6,020,698 | A | | 2/2000 | Stenger et al. |
| 6,047,486 | A | * | 4/2000 | Reck et al. ..... 34/491 |

* cited by examiner

*Primary Examiner*—Pamela Wilson
(74) *Attorney, Agent, or Firm*—Diederiks & Whitelaw, PLC

(57) ABSTRACT

A method of programming and controlling an automatic cycle of a clothes dryer provides that, after positioning of a selection dial, a motor associated with the selection dial is rapidly moved to a predetermined location at a constant speed, while the time to do so is measured. With the rotational velocity being known, the exact, initially setting position of the dial is determined in advance.

18 Claims, 3 Drawing Sheets

METHOD AND APPARATUS FOR DRYNESS DETECTION IN A CLOTHES DRYER

BACKGROUND OF THE INVENTION

1. Field of the Invention

The present invention relates to a control system for a clothes dryer and, more particularly, to a clothes dryer control system incorporating a moisture sensor used to terminate a drying process when the amount of moisture present in the clothes inside the dryer reaches a desired level as selected by a user.

2. Discussion of the Prior Art

It is well known in the art to provide a clothes dryer with a simple time-dry control, in addition to a sensor-dry mode. When the time-dry control is used, the user simply places wet articles inside the dryer and selects the duration for the drying process. Because there is little or no automatic control or adjustment during the process, the drying process simply continues until the time expires. The result can be inefficient, because it is difficult for a user to accurately estimate the time required to reach a desired, final moisture level prior to operating the machine.

In comparison, sensor-dry modes are provided to automatically control a drying operation. Specifically, when a sensor-dry mode is selected, the user places wet articles inside the dryer drum and selects a desired final dryness level. Instead of forcing the user to guess as to how long the process should take, the machine stops when the desired dryness level is reached. For this purpose, the machine includes at least one moisture sensor for detecting the level of moisture of the articles. The machine simply operates until the moisture sensor detects the final desired dryness level selected by the user. By terminating the process upon achieving the desired final dryness level, there is no need to re-start the process to finish incomplete drying. In addition, extra energy is not expended to dry the articles beyond the desired dryness level.

Electronic controls have been developed to assist in the operation of such an automatic drying processes. For example, U.S. Pat. No. 3,762,064, to Offut, discloses a system for automatic operation of a dryer in which extra time is added to a drying process according to a predetermined table. A selection of a dryness level beyond a predetermined level (e.g. damp-dry) results in the addition of extra time. The duration of this extra time is dependent upon the length of time required to reach the predetermined dryness level and the desired final dryness level selected by the user. While this system incorporates a moisture sensor for making a drying operation more efficient, this system is nevertheless highly inefficient, because only one threshold dryness level is detected and the final dryness level is never actually measured, as the time to reach that level is simply estimated. Therefore, just as in time dry modes, the articles will often either be under-dried and still wet, or over-dried.

U.S. Pat. No. 4,477,892, to Cotton, represents an improvement over the system disclosed in the '064 patent and includes sensors or electrodes which contact the wet articles to determine the current moisture level contained therein. Through the system of this patent, the current moisture level inside the machine can be measured at a variety of continuous levels. By comparing the number of conductive electrode "hits" during a given time period, it is possible to estimate the current degree of dryness.

However, there still remains a concern regarding the programming of the operation controller. U.S. Pat. No. 6,020,698 to Stenger et al. discloses the use of multiple binary switches to program an electromechanical timer and an electronic control circuit. A plurality of timer switches are included in relation to a control knob to provide control input, and changing from one control position to an adjacent control position results in a switch either being opened or closed. However, this system only allows a small number of different settings to the microprocessor or electronic control circuit, dependent upon the number of timer switches. Increasing the variability, therefore, requires increasing the number of timer switches and, accordingly, greatly increasing the cost.

Based on the above, there exists a need in the art to provide a control system for a clothes dryer which allows for programming of a wide range of final desired dryness levels, while efficiently drying the clothes contained therein, in a cost efficient manner. Additionally, there exists a need for a clothes dryer which quickly recognizes a dry condition upon commencing a drying cycle and powers down without running a heater.

SUMMARY OF THE INVENTION

The present invention is particularly directed to a control system for a clothes dryer including a timer used to calculate an initial position of a dial or control knob. For instance, during operation of the control system of the invention, the user can select a sensor-dry mode by rotating the dial to a position indicating the final desired dryness level of the articles contained within the dryer. Upon pressing a start button, an internal motor quickly rotates the dial to a preset position, and the time to do so is measured. Because the control system of the invention is programmed with the speed at which the dial is rotated, the initial position of the knob can be quickly and easily determined by multiplying the rotational speed by the time required to rotate the knob. The result is compared to the output from a typical moisture sensor, and drying operation is halted when the detected moisture level reaches the selected level.

Preferably, the control system, via the motor, is capable of driving the dial at different speeds. The first, or fast speed, is used during the initial programming procedure, as described above. A second, or slower speed, is used during the remainder of the sense dry cycle. By providing these varying rotational speeds, greater control and variability is permitted.

Additional objects, features and advantages of the invention will become more readily apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENTS

Figure 1:
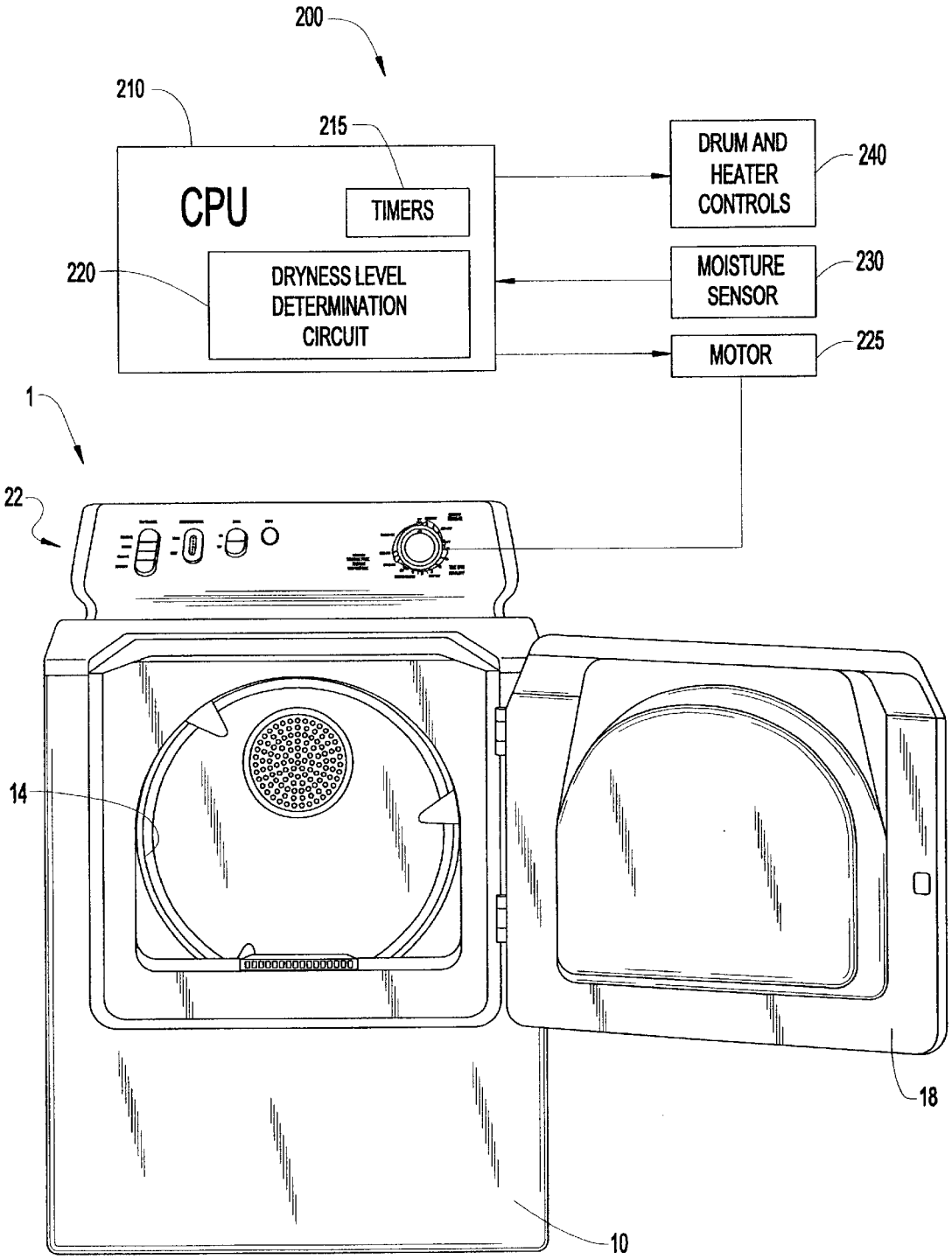
FIG. 1 is a front perspective view of a clothes dryer incorporating a dryness level detection and display system according to the invention.

A clothes dryer 1 of the current invention is shown in FIG. 1 and generally includes an outer cabinet 10, having an opening leading to a rotatable drum 14 and a door 18 for closing the opening. Disposed on the upper surface of the outer cabinet is a control panel 22 for establishing a desired operational sequence for programming the clothes dryer 1 of the invention.

Figure 2:
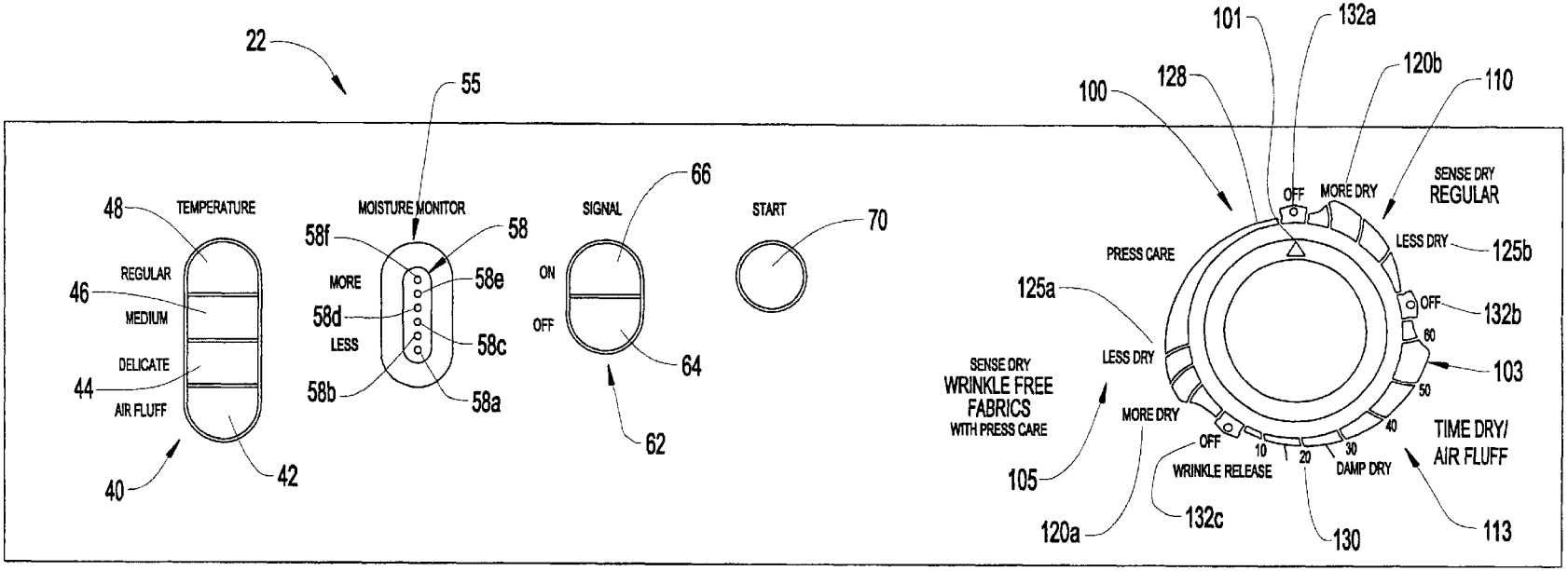
FIG. 2 is a front view of a control panel provided on the clothes dryer of FIG. 1.

FIG. 2 depicts a close-up view of control panel 22 and includes a plurality of buttons and other elements for controlling clothes dryer 1. Although control panel 22 is described below in a specific arrangement, it should be understood that the particular arrangement is only exemplary, as a wide range of layouts would suffice. Accordingly, disposed on the left side of control panel 22 is a temperature selector 40, which includes buttons for determining the heat output of the clothes dryer 1. In the most preferred embodiment, temperature selector 40 includes an air fluff button 42, a delicate button 44, a medium button 46 and a regular button 48.

Next to temperature selector 40 is a moisture monitor 55 for displaying the current moisture state of articles contained within clothes dryer 1. Moisture monitor 55 is shown as including a set of LEDs 58 for indicating the specific moisture level. Because the LEDs 58 are vertically arranged, individual LEDs 58*a–f* can be illuminated to indicate a current moisture level. For example, a low moisture level can be signified by illuminating only LED 58*a*, while a higher moisture level can be shown by illuminating LED 58*d* alone or LEDs 58*a*, 58*b*, 58*c* and 58*d* simultaneously.

Proximate to moisture monitor 55 is a signal controller 62. Signal controller 62 is provided to selectively regulate the operation of a buzzer (not shown), and includes an OFF button 64 and an ON button 66. The selection of ON button 66 causes the buzzer to sound upon completion of the drying operation, while selection of OFF button 64 prevents the buzzer from sounding upon completion of the drying operation. Additionally, control panel 22 includes a start button 70 for commencing operation of clothes dryer 1.

Finally, control panel 22 includes a control dial 100 for programming clothes dryer 1. Disposed on the periphery of the center surface of dial 100 is a location pointer 101 which indicates an established setting for dial 100. Annularly disposed about the periphery of dial 100 is indicia 103 which illustrates the various settings. Specifically, indicia 103 includes a first sense dry zone 105, a second sense dry zone 110 and a time-dry zone 113, each defining a portion of indicia 103 and designed to indicate the mode of dryer operation, i.e. a sense dry mode, or a time dry mode. Sense dry zones 105 and 110 each include a MORE DRY setting 120*a*, 120*b* and a LESS DRY setting 125*a*, 125*b* with continuous levels therebetween. First sense dry zone 105 also includes a press care setting 128. Each zone 103, 105 and 113 includes a cool down sequence at the end of the desired cycle, although not specifically labeled in each zone 103, 105 and 113. A plurality of time increments 130 are defined by indicia 103 in time-dry zone 113. Finally, disposed between each of zones 105, 110 and 113 are OFF positions 132*a–c*. Depending upon the operational state of clothes dryer 1, dial 100, and hence location pointer 101, will reference the appropriate indicia 103.

With reference to FIG. 1, clothes dryer 1 also includes a control circuit generally indicated at 200. Specifically a CPU 210 is provided with a timer 215, and a dryness level determination circuit 220. A motor 225 is provided to drive timer 215 upon direction from CPU 210. A moisture sensor 230 is provided as an additional input to CPU 210. Moisture sensor 230 may be any conventional moisture sensor known in the art, such as the moisture sensor described in U.S. Pat. No. 4,477,982, to Cotton, which is hereby incorporated in its entirety by reference. A series of drum and heater controls are collectively represented at 240 which, when directed by CPU 210 through timer 215, operate a drum rotation motor (not shown) and a heating element (not shown) in response to a drying profile set by the elements on control panel 22 and the output from CPU 210.

After wet articles are placed within drum 14, a user selects an operation in a generally conventional manner. First, temperature selector 42 is used to chose a desired operating temperature for clothes dryer 1. While selection regular button 48 uses the highest temperature setting and results in the fastest drying time, the "regular" setting may be too hot for some articles. Therefore, additional temperature levels are provided. Before pressing start button 70 and beginning operation of clothes dryer 1, the user rotates dial 100 from OFF setting 132 into time-dry zone 113, first sense dry zone 105 or second sense dry zone 110.

If dial 100 is rotated such that location pointer 101 is in time-dry zone 113, clothes dryer 1 is in time-dry mode, and simply operates until the time indicated by time increment 130 expires. CPU 210 directs motor 225 to rotate dial 100 at a relatively slow speed through a reduced duty cycle coinciding to time increments 130, and operates the heater at the temperature chosen via temperature selector 42. Rotation of drum 14 continues until location pointer 101 reaches OFF setting 132c. If desired, moisture sensor 230 could be designed to operate during the time-dry mode to display to the user the current moisture level via moisture monitor 55, even though the sense dry mode was not selected.

The present invention is particularly directed to the operation of clothes dryer 1 in one of sense dry zones 105 or 110. Second sense dry zone 110 is provided for automatic operation of clothes dryer 1 in most situations. However, first sense dry zone 105 is generally provided for use with permanent press articles or when the user wants wrinkles prevented. The two sense dry zones 105 and 110 operate in substantially the same manner, as commonly known in the art, with their differences not forming part of the present invention. First sense dry zone 105 directs a "wrinkle-free" cycle and therefore, includes press care setting 128 and operates at a lower temperature with an extended period of no added heat, i.e. an air fluff mode, than the cycle directed by second sense dry zone 110 so as to extend tumbling to limit creasing of articles. Because operation of clothes dryer 1 is substantially the same for first sense dry zone 105 and second sense dry zone 110 in accordance with the invention, only one description follows, making specific reference to first sense dry zone 105.

Figure 3:
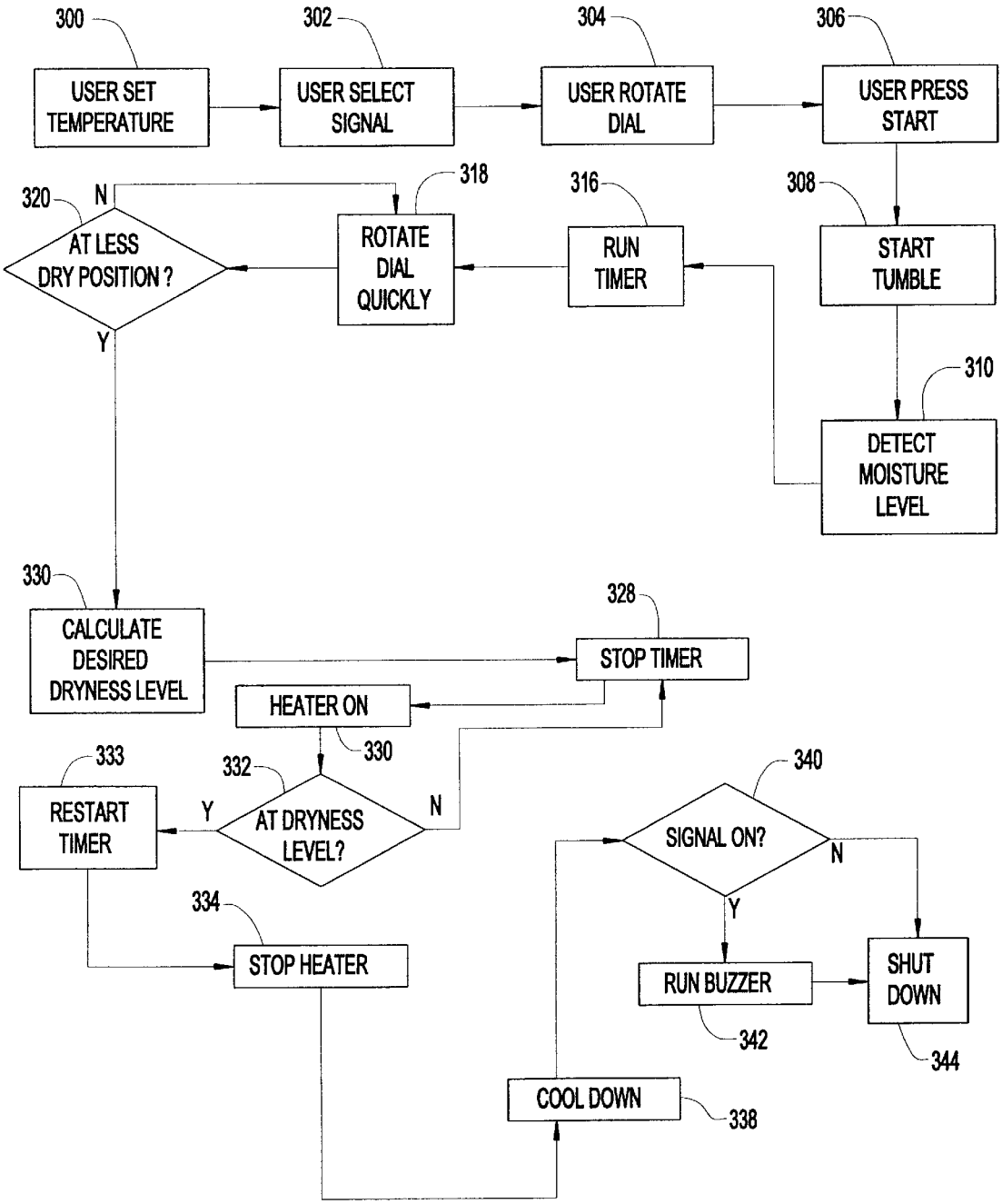
FIG. 3 is a diagrammatic representation of a typical control sequence of a sensor dry mode according to the invention.

With reference to the drawings and particularly FIG. 3, just as when time-dry zone 113 is used, when a sense dry mode of clothes dryer 1 is called for, the user places the wet articles inside drum 14, chooses a drying temperature with temperature selector 40 (Step 300), selects signal ON or OFF (302), and indicates the desired, final dryness level by rotating dial 100 until location pointer 101 points to the desired level (Step 304). Specifically, the desired setting may be either MORE DRY setting 120, LESS DRY setting 125 or somewhere between. After start button 70 is pressed (Step 306), CPU 210 through timer 215 begins tumbling of drum 14 (Step 308).

In a preferred embodiment, CPU 210 measures the current moisture level within drum 14 via moisture sensor 230 upon commencing tumbling of drum 14 (Step 310). Timer 215 is then activated by CPU 210 (Step 316) to rotate dial 100 to determine its position or setting (Step 318). Specifically, dial 100 is rotated at a relatively fast rate, e.g. 8°/minute, as opposed to the slower speed of 2°/minute. Although in a preferred embodiment, dial 100 rotates at the same speed internally and externally, it is contemplated to rotate dial 100 at the slower speed externally, while moving four times as fast internally, as to maintain a substantially constant rotation as viewed by the user. More specifically, timer 215 rotates dial 100 at a constant known rate from its initial position to LESS DRY setting 125 (Step 320). Because the rotational velocity is known, CPU 210 calculates the arc length traveled by dial 100 during this period. By multiplying the preset rotational velocity by the rotation duration of timer 215, the arc length traversed can be calculated (Step 324). For example, if dial 100 is set in close proximity to LESS DRY setting 125, the rotation period will be substantially less than if dial 100 were set closer to MORE DRY setting 120. CPU 210 converts this distance value into a dryness level, to be compared to the result from moisture sensor 230 by dryness level determination circuit 220. At Step 328, timer 215 is stopped, which halts rotation of dial 100 until later in the cycle.

As indicated above, motor 225 rotates dial 100 at a different rate when in a sensor-dry zone 105 or 110 as compared to time-dry zone 113. This allows for a greater degree of selection and flexibility in the layout of indicia 103 in the sensor dry zones 105 and 110. By advancing dial 100 at a faster rate, in effect, more gradations are possible in the sensor-dry zone. In a preferred embodiment, motor 225 rotates dial 100 at a rate of 8° per minute when in sensor-dry zone 105 or 110 and advances dial 100 at a rate of 2° per minute when in time dry zone 113. Preferably, this is accomplished by advancing dial 100 for 15 seconds out of every 60 seconds.

The heater is then energized (Step 330) and clothes dryer 1 operates with dial 100 in LESS DRY selection 125 until the final dryness level is reached (Step 332). By continually monitoring the output from moisture sensor 230, and comparing the output to the desired, final dryness level, dryness level determination circuit 220 causes CPU 210 to advance to the next step when the final dryness level is reached. Essentially, the rotational movement of dial 100 is halted until the desired dryness level is achieved by cycling between Steps 328–332. When the final desired dryness level is achieved, CPU 210, through timer 215, restarts timer 215 at the slower speed (Step 333), and de-energizes the heater, but permits the continuation of tumbling of drum 14 (Step 334). Once the heater is de-energized, clothes dryer 1 enters cool-down mode (Step 338).

If ON button 66 of signal controller 62 is depressed (Step 340), CPU 210 sounds the buzzer or other notification device to alert the user of the completion of the drying cycle (Step 342). If, however, OFF button 64 is depressed, CPU 210 does not actuate the buzzer and proceeds to the next step. Finally, CPU 210 and drum and heater controls 240 stop tumbling of drum 14 and shuts down clothes dryer 1 (Step 344).

The particular arrangement of CPU 210 within dryer 1 is designed to prevent excessive heating of articles contained in drum 14 if a dry condition is realized at the initiation of a drying cycle. If dyer 1 is started with an already dry load (or no load at all) therein, this will be detected by moisture sensor 230 in Step 310. Because this reading will be below any desired dryness level calculated in Step 324, when CPU 210 progresses to Step 332, CPU 210 will quickly move through Steps 330–334 and almost immediately stop the heater. Therefore, in the event that an already dry load is placed within drum 14, the heater will only remain energized for a short duration.

With this arrangement, the actual operator established setting between MORE DRY and LESS DRY in either of sense dry zone 105 or 110 is determined by CPU 210 well in advance of reaching a LESS DRY status for the clothes. Although not shown, CPU 210 could be used to control a visual numeric or other type of read-out (not shown) provided on control panel 22 or elsewhere, to indicate to the user the amount of time to an end of cycle. Therefore, although described with reference to preferred embodiments, it should readily understood that various changes and/or modifications could be made to the invention without departing from the spirit thereof. For example, selection element 100 need not be a dial, as one of ordinary skill in the art would recognize that using a slidable element would be within the scope of this invention. Additionally, indicia 103 may include a variety of additional dryer cycles, or simply a single sense dry zone. In any event, the invention is only intended to be limited by the scope of the following claims.

I claim:

1. A clothes dryer comprising:

an outer cabinet shell;

a drum rotatably mounted within said outer cabinet shell, said drum being adapted to receive articles of clothing to be heated and dried within said drum;

a system for sensing a moisture level of articles of clothing placed within said drum;

a control panel including at least one temperature selector member, a cycle selection element adapted to be initially positioned by a user to a desired dryness level setting while being movable through a first cycle zone during operation of said clothes dryer, and indicia, representative of said first cycle zone, extending adjacent at least a portion of said cycle selection element on said control panel; and means for determining the desired dryness level setting based on movement of the selection element through the first cycle zone during operation of said clothes dryer.

2. The clothes dryer according to claim 1, wherein the said determining means measures a period of time needed by the cycle selection element to move through the first cycle zone.

3. The clothes dryer according to claim 2, wherein said determining means includes a control unit which determines the desired degree level setting by multiplying a predetermined rate of movement by the period of time.

4. The clothes dryer according to claim 1, wherein said determining means calculates the dryness level setting in advance of an actual completion of a cycle represented by the first cycle zone.

5. The clothes dryer according to claim 1, wherein said cycle selection element constitutes a dial, said dial being provided with a location pointer directed to said indicia.

6. The clothes dryer according to claim 5, wherein said indicia presents final desired moisture levels for the articles of clothing, said indicia including indications corresponding to more dry and less dry level settings.

7. The clothes dryer according to claim 6, further comprising: means for rotating said dial at a substantially constant first rate from the desired dryness level setting to the less dry level setting.

8. The clothes dryer according to claim 7, wherein said first rate equals approximately 8° per minute.

9. The clothes dryer according to claim 7, wherein during operation of the clothes dryer, the cycle selection element further moves through a second cycle zone, said rotating means moving said dial at a second rate, which is lower than the first rate, within the second cycle zone.

10. The clothes dryer according to claim 9, wherein the second rate equals approximately 2° per minute.

11. The clothes dryer according to claim 9, wherein the second rate is less than half the first rate.

12. A method of operating a clothes dryer comprising:

initiating a dryer operation based on a desired dryness level setting established by a user through a positioning of a cycle selection element in a first cycle zone;

determining the desired dryness level based on advanced movement of the cycle selection element through the first cycle zone;

sensing a moisture level of clothing articles in the clothes dryer during the drying operation; and halting operation of at least a heater of said clothes dryer when the moisture level is substantially equal to the desired dryness level.

13. The method according to claim 12, wherein determining of the desired dryness level includes measuring a time needed by the cycle selection element to move through the first cycle zone.

14. The method according to claim 13, wherein the determining of the desired dryness level includes multiplying the time by a predetermined first rate of movement.

15. The method according to claim 14, wherein the predetermined first rate of movement equals 8° per minute.

16. The method according to claim 14, further comprising: moving the cycle selection element through a second cycle zone at a second rate, which is lower than the first rate, during the drying operation.

17. The method according to claim 16, wherein the second rate equals approximately 2° per minute.

18. The method according to claim 16, wherein the second rate is less than one-half the first rate.

* * * * *